US008016957B2

(12) United States Patent
Zeng et al.

(10) Patent No.: US 8,016,957 B2
(45) Date of Patent: Sep. 13, 2011

(54) MAGNESIUM GRAIN-REFINING USING TITANIUM

(75) Inventors: Xiaoqin Zeng, Shanghai (CN); Yingxin Wang, Shanghai (CN); Wenjiang Ding, Shanghai (CN); Aihua A. Luo, Troy, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 1358 days.

(21) Appl. No.: 11/347,003

(22) Filed: Feb. 3, 2006

(65) Prior Publication Data

US 2007/0181226 A1 Aug. 9, 2007

(51) Int. Cl.
*C22C 23/00* (2006.01)

(52) U.S. Cl. ..... 148/420; 420/407

(58) Field of Classification Search ..... 148/420; 420/407

See application file for complete search history.

(56) References Cited

U.S. PATENT DOCUMENTS 5,143,564 A 9/1992 Gruzleski et al.

FOREIGN PATENT DOCUMENTS

WO WO 03/095689 A1 * 11/2003

OTHER PUBLICATIONS

ASM Alloy Center: Worldwide Guide to Equivalent Nonferrous Alloys, 4th ed., ASM International 2001, "Cast magnesium-aluminum-zinc, AZ91 (CSA HG.11)", http://products.asminternational.org/alloyfinder/index.jsp.*

Y.C. Lee, A.K. Dahle, and D.H. StJohn, The Role of Solute in Grain Refinement of Magnesium, Metallurgical and Materials Transactions A, vol. 31A, Nov. 2000, p. 2895-2906.

J.F. Wallace, D. Schwam and Y. Zhu, The Influence of Potential Grain Refiners on Magnesium Foundry Alloys, AFS Transactions 2003, American Foundry Society.

* cited by examiner

*Primary Examiner* — Jessee R. Roe
(74) *Attorney, Agent, or Firm* — Reising Ethington P.C.

(57) ABSTRACT

The grain size of magnesium alloys is effectively refined and made smaller by the addition of a small amount of titanium. The effect of the reduction of grain size is often an improvement in the strength and processability of a cast magnesium alloy. Often less than about 0.1% by weight of titanium need be used. It may be preferred to incorporate the titanium with another alloying constituent (such as aluminum) for addition to a melt of a magnesium base alloy.

8 Claims, 2 Drawing Sheets

MAGNESIUM GRAIN-REFINING USING TITANIUM

TECHNICAL FIELD

This invention pertains to a method for improving physical properties in cast and wrought magnesium alloys by producing finer grain sizes in these materials. More specifically, this invention pertains to the use of a small amount of titanium as a grain refiner in such magnesium alloys.

BACKGROUND OF THE INVENTION

Individual crystals in the microstructure of a solidified metal alloy are referred to as grains. Grain refinement is a very important technique for improving the mechanical properties of metallic components because grain size affects grain boundary strengthening. It is also well known that finer grain structure in direct-chill cast alloy billets can increase the maximum extrusion speed and hence reduce the cost of extruded products. Furthermore, finer grain sizes will improve the quality of alloy billets and castings due to a reduction in size of defects such as hot cracking and microporosity. Grain refining can also result in finer and more uniform distribution of intermetallic particles in the as-cast material which will increase the efficiency of subsequent homogenizing treatment and reduce heat treating time. The effect of grain refining is particularly significant in magnesium alloys.

Aluminum, manganese, and zinc are common alloying elements for magnesium-based alloys. Aluminum in amounts up to about ten percent by weight is used in many magnesium alloys. Many grain-refining techniques have been developed for melts of Mg—Al alloy systems, such as superheating, carbon addition, agitation, and additions of particles such as $Al_4C_3$, AlN, SiC, TiC, $CaC_2$ and solute elements such as B, C, Ce, La, Nd, Sr, and Y. Among these techniques, addition of carbon-containing agents to the melt offers more practical advantages because they require lower operating temperatures and their grain-refining effect is slower to fade. However, adding carbon-containing agents such as $C_2Cl_6$ or $CCl_4$ have environmental concerns due to the emission of chlorine. Also, grain refiners like $C_2Cl_6$ are not very effective in heavy solidified sections.

The commercial magnesium alloy, AZ31 (Mg-3% Al-1% Zn, concentrations in weight percent) offers a good combination of mechanical properties, castability, and extrudability for automotive vehicle components and other articles of manufacture. But there remains a need for an improved method of treating melts of such aluminum-containing magnesium-base alloys to control and reduce the grain size in the solidified product.

SUMMARY OF THE INVENTION

Magnesium based alloys are used in many casting methods to form cast products for many purposes. In accordance with a preferred embodiment of this invention, small amounts of titanium are added to the melt of an aluminum-containing magnesium base alloy to reduce or refine average grain size in cast ingots and shaped products. The titanium is suitably added to a melt in the form of an aluminum-titanium master alloy, such as a 90 weight % Al and 10 weight % Ti master alloy (Al-10% Ti). The aluminum content of the master alloy, of course, contributes to the required aluminum content of the magnesium alloy being formulated in the melting furnace or device. In the case of AZ31 an addition of about 0.01 weight percent titanium significantly refines the average grain size of the solidified material over normal cooling rate ranges. This refinement in grain size improves the tensile yield strength and elongation of the cast product.

The amount of titanium required for grain-refinement in magnesium alloys is, thus, quite low and the titanium is preferably added in an aluminum-titanium master alloy for easier control of the amount of titanium addition to the melt. The inclusion of titanium in an aluminum-titanium master alloy (for example, by weight, 90% Al-10% Ti) permits the controlled addition of both elements to the magnesium alloy melt within desired compositional limits. It appears that the resulting grain refinement in the solidifying melt is due to grain growth restriction resulting from rejected titanium solute atoms ahead of the solid/liquid interface during solidification.

Other objects and advantages of the invention will become apparent from a detailed description of embodiments of the practice of the invention which follows.

DESCRIPTION OF PREFERRED EMBODIMENTS

Figure 1:
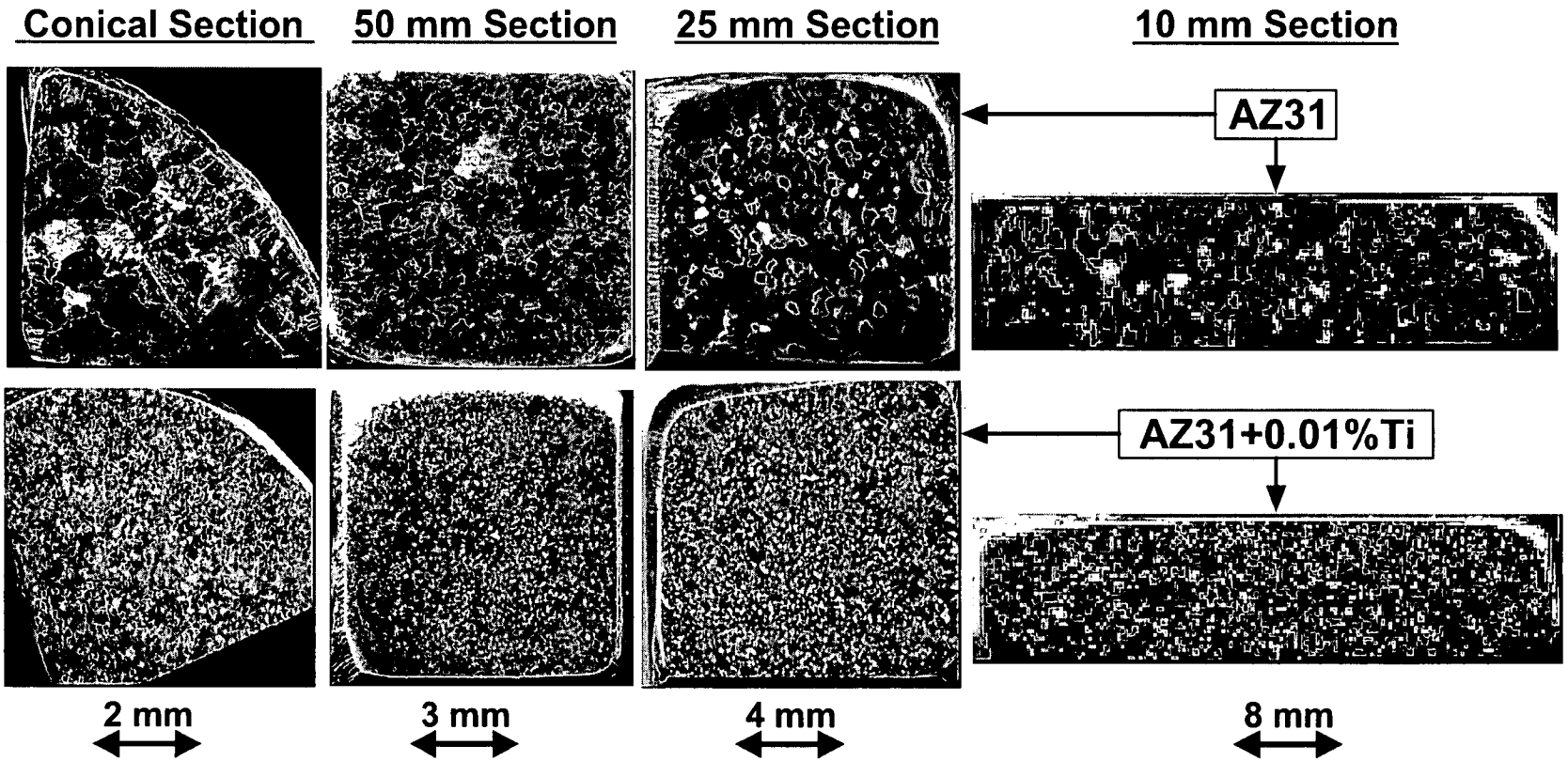
FIG. 1 presents a group of eight photomicrographs depicting grains sizes resulting from four different cooling rate sections, respectively, in AZ31 magnesium alloy castings and AZ31+0.01% titanium castings. The four photomicrographs of different cooling rate sections from AZ31 castings are arranged in a row over the photomicrographs of the sections of titanium treated AZ31 alloys at corresponding cooling rates.

Commercial magnesium alloy systems adapted for sand and permanent mold castings include magnesium-aluminum-manganese (AM), magnesium-aluminum-zinc (AZ), magnesium-rare earth-zirconium (EK, EZ, and ZE), magnesium-zinc-zirconium (ZK), and magnesium-thorium-zirconium (HK, HZ, and ZH). AZ and AM alloys are also used in high-pressure die casting applications. Other die cast alloys include magnesium-aluminum-silicon (AS) magnesium-aluminum-strontium (AJ), magnesium-aluminum-rare earth (AE). Compositional specifications, temper specifications, and physical properties for alloy members of these systems are available from commercial sources and technical references. Wrought magnesium alloys, produced as bars, billets, shapes, wire, sheet, plate, and forgings, are often made using members of the AZ system, such as AZ31 B, C having a typical nominal composition, by weight, of 3.0% aluminum, 0.3% manganese, 1% zinc, and the balance magnesium. Extruded bars, rods, tubes, and the like, may be made of magnesium alloy systems such as AZ80A and ZK60A. The practice of the invention is applicable to these families of magnesium alloys, and especially the aluminum-containing magnesium base alloys.

A preferred practice of the invention will be illustrated using commercial AZ31 B because it offers general utility for making components for structural applications.

A group of AZ31B-type magnesium alloy castings were prepared with alloy compositions as summarized in the following Table 1.

TABLE 1

Chemical composition of the experimental magnesium alloys

| Alloy No. | Al | Zn | Mn | Grain Refiner | Mg |
|---|---|---|---|---|---|
| 1 | 2.84 | 0.97 | 0.22 | — | Bal. |
| 2 | 3.01 | 0.97 | 0.22 | 0.01Ti (0.1Al—10Ti) | Bal. |
| 3 | 3.19 | 0.97 | 0.22 | 0.03Ti (0.3Al—10Ti) | Bal. |
| 4 | 3.34 | 0.97 | 0.22 | 0.05Ti (0.5Al—10Ti) | Bal. |
| 5 | 4.08 | 0.97 | 0.22 | — | Bal. |

Alloy No. 1 is a commercial AZ31B magnesium alloy prepared as a baseline material for comparison with alloys of this invention containing titanium as a grain refiner. Alloys 2-4, prepared from the AZ31B alloy, contain by weight 0.01% titanium, 0.03% titanium, and 0.05% titanium, respectively, as a grain refiner. Titanium was added as a component of a master alloy consisting by weight of 90% aluminum and 10% titanium. AZ41 alloy (Alloy No. 5) was made as a comparison alloy by adding 1% Al to the AZ31B magnesium alloy since the Al content of some of the Ti-containing AZ31 alloys approached 4% due to the Al introduced by the Al-10% Ti master alloy.

Experimental

Commercial AZ31B magnesium alloy ingots were melted in an electrical furnace in a mild steel crucible under a protective cover gas mixture of 0.3% $SF_6$ and 99.7% $CO_2$. Titanium in the form of Al-10% Ti master alloy was added into the melt at 690° C. The melt was held as it was further heated for 30 min and then stirred for 2 min. at 750° C. The melts of Alloys 1-5 were successively poured at 720° C. into mild steel molds preheated to 200° C. The steel mold casting cavities were shaped to obtain varying cooling rates to evaluate the grain refining effect of the small additions of titanium.

One mold was a round cylindrical block of steel with a diameter of 100 millimeters and a height of 70 millimeters. The mold was machined to have a concentric, inverted, round truncated conical cavity 45 millimeters deep. The round base of the conical cavity opening at the top of the mold was 50 millimeters in diameter. The truncated surface of the conical cavity had a diameter of 35 millimeters. After a cast magnesium alloy cone was removed from the mold, metallographic sections were examined at a level that was 25 mm from the small base (bottom) of the cone as cast.

A second mold was machined from a rectangular block of steel, 290 mm long by 160 mm wide by 80 mm high. The mold was machined to have a cavity that included successive flat steps of increasing heights of 1 mm, 5 mm, 10 mm, 25 mm, and 50 mm from a chill plate at the bottom of the mold. The steps were centered with parallel sides 30 millimeters from each side of the metal mold. Metallographic sections were prepared at locations on the upper surfaces of the cast steps that were 15 mm inward from the sides of the steps.

Cooling rates for the casting experiments were recorded from the thermocouples placed in the center of the conical mold and in the middle of each step thickness of the step mold. The results showed a cooling rate of about 4° C./sec. for the conical mold; 4.5, 6, and 10° C./sec. for the step mold at the section thicknesses of 50 mm, 25 mm, and 10 mm, respectively.

All samples were subjected to a solid solution treatment (10 hours at 450° C.) to distinctly reveal the grain boundaries. Samples were etched with the Acetic-Picral etchant (4.2 g picric acid, 70 ml ethanol, 10 ml acetic acid and 10 ml $H_2O$) for microstructural analysis. Grain size measurements and qualitative analysis were conducted on a selected number of specimens with a Leica MEF4M optical microscope and a JSM-5600LV Scanning Electron Microscopy (SEM) coupled with an Energy Dispersive X-ray (EDX) system.

Tensile specimens with a gage section of 15 mm by 4 mm by 2 mm were sectioned using electric spark machining from the ingots and tensile testing was performed on a Zwick/Roell material test machine at ambient temperature. Fracture surfaces of typical tensile specimens were analyzed with SEM.

Figure 2A:
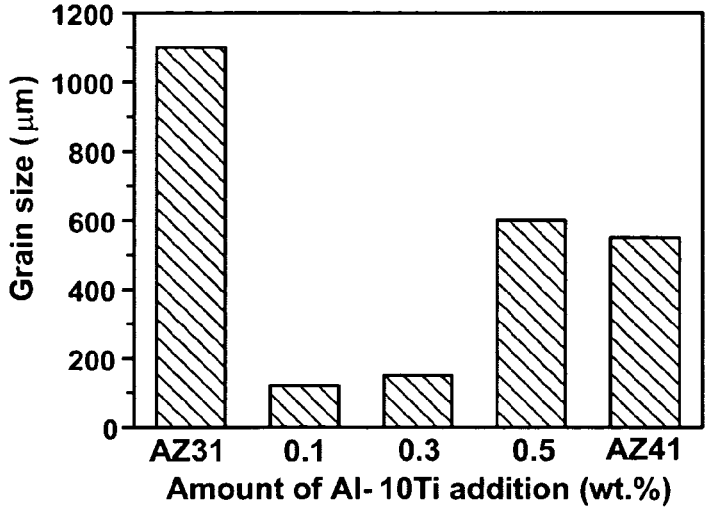
FIG. 2A is a graph of grain size in micrometers for comparable cooling rate samples of an AZ31 alloy casting, an AZ31+0.1% Al—Ti casting, an AZ31+0.3% Al—Ti casting, an AZ31+0.5% Al—Ti, and an AZ41 casting (Alloys 1-5 below).
Figure 2B:
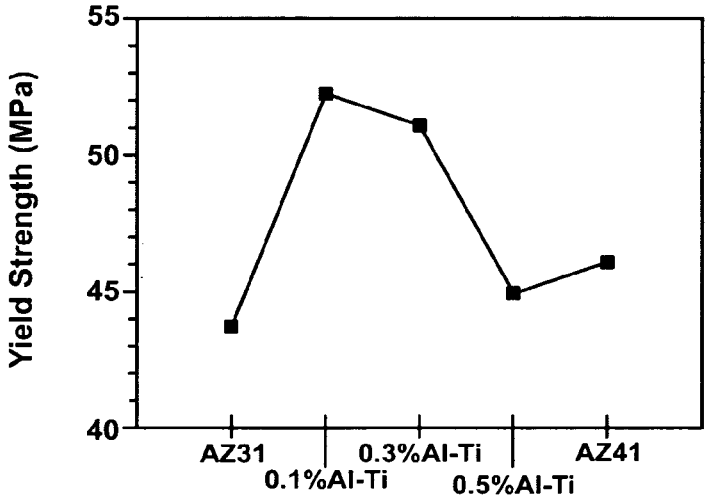
FIG. 2B is a graph of tensile yield strengths for Alloys 1-5.
Figure 2C:
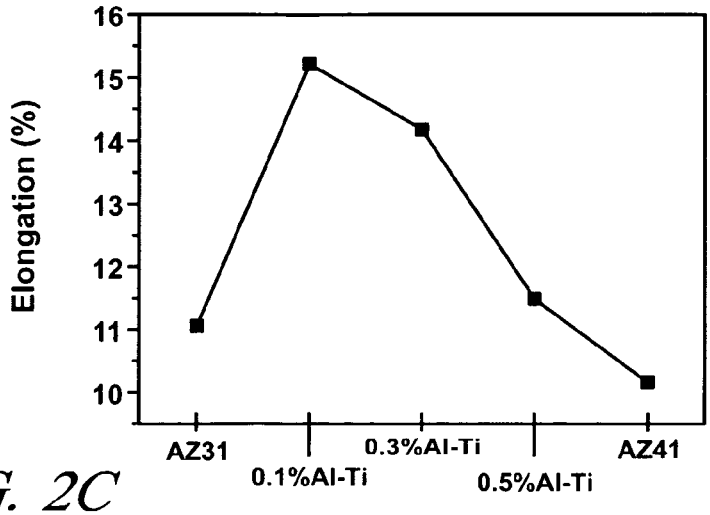
FIG. 2C is a graph of tensile elongation for Alloys 1-5.

The strong effect on grain size and physical properties of small additions of titanium in castings of AZ31 magnesium alloys is clearly shown in the photomicrographs of FIG. 1 and the graphs of FIGS. 2A-2C.

The upper row of four photomicrographs of FIG. 1 show (from left to right) the metallurgical microstructure of the conical section of the AZ31 casting and microstructures of the cast AZ31 step surfaces at levels of 50 mm, 25 mm, and 10 mm, respectively, from a mold surface. The underlying lower row of photomicrographs show microstructures of like cast surfaces of cast AZ31 composition plus 0.01 weight percent titanium (Alloy 2). In each comparative photograph, the grain size of magnesium in the cast magnesium alloy containing the very small amount of titanium is much smaller.

An average grain size was determined for the castings of Alloys 1-5 and like representative samples prepared for physical testing. FIG. 2A shows that the average grain size of the AZ31 castings was about 1100 micrometers in diameter or largest dimension. The addition of 0.01 weight percent titanium to AZ31 alloy reduced the average grain size by about 90% to about 110 μm. The addition of 0.03 weight percent titanium (Alloy 3) produced grains of about 150 μm diameter, and the addition of 0.05 weight percent titanium (Alloy 4) produced grains of about 600 μm size. The grain size of the cast AZ41 alloy was about 550 μm.

The yield strengths (in MPa) of the five different cast alloys are summarized in FIG. 2B. The reduced grain size obtained in Alloy 2 (AZ31+0.01 Ti) increased the yield strength by about 20% and the percent elongation (FIG. 2C) by about 38%

Titanium is an effective grain refining additive for cast magnesium base alloys, especially where magnesium makes up 75% by weight or more of the cast alloy. The effect is achieved with quite small amounts of titanium, for example with less than 0.1 percent by weight based on the weight of the magnesium alloy. Since such small amounts are effective, it may be preferred to add the titanium as part of a master alloy containing a constituent otherwise present in the base alloy. Since many magnesium alloys contain aluminum, it is often useful to incorporate titanium with aluminum in an aluminum base master additive alloy for more uniform addition to and dispersion in the magnesium alloy melt being prepared.

Magnesium alloys have been developed for many casting methods such as sand mold casting, permanent mold casting, low pressure die casting, medium pressure die casting, and investment casting. The cooling rates of the cast material and the grain sizes of the solidified products vary by casting method and cavity shape. But the use of titanium as a grain-refining additive in the cast alloy can be adapted to these and other casting methods.

In the practice of the invention a suitable magnesium base alloy is selected for casting by a selected casting mode into a billet or article of predetermined shape. The casting mode and article shape will lead to a suitable mold design with provision for suitable mold cooling. Test castings can be made to evaluate the metallurgical grain structure throughout different cooling rate sections of the cast article. When it is determined that a reduction of grain size is required or preferred, additional test castings are made with melts to which test amounts of titanium have been added. When a suitable amount and mode of titanium addition has been determined, production castings are made with the predetermined titanium addition to the melt just before casting. In general, it is expected that titanium additions up to about 0.1% by weight of the melt will be suitable. Often it will be preferred to add the small amount of titanium with another alloying constituent that is being used to make up the composition of the melt and cast article.

While the practice of the invention has been illustrated by examples, these examples do not limit the applicability and scope of the invention.

The invention claimed is:

1. A method of making a casting, by a selected casting mode, of a selected magnesium-based alloy composition with metallurgical microstructural grains of refined size or shape, the method comprising:

adding a predetermined amount of titanium as a microstructural grain-refiner to a melt of a selected magnesium-based alloy composition, the titanium being the sole grain-refining additive; and pouring the melt to produce the magnesium-based alloy casting.

2. A method of making a magnesium-based alloy casting as recited in claim 1 in which the magnesium-based alloy casting comprises at least 75% by weight magnesium.

3. A method of making a magnesium-based alloy casting as recited in claim 1 in which titanium is added in an amount up to about 0.1% by weight.

4. A method of making a magnesium-based alloy casting as recited in claim 1 in which titanium is added in an amount up to about 0.1% by weight as part of a master additive alloy consisting of titanium and at least one constituent of the magnesium-based alloy composition.

5. A method of making a magnesium-based alloy casting as recited in claim 1 in which the magnesium-based alloy casting comprises at least 75% by weight magnesium and aluminum in an amount up to about 10% by weight.

6. A method of making a magnesium-based alloy casting as recited in claim 5 in which titanium is added in an amount up to about 0.1% by weight as part of an aluminum and titanium containing master additive alloy.

7. A method of making a magnesium-based alloy casting as recited in claim 6 in which the master additive alloy consists essentially of aluminum and titanium.

8. A method of making a magnesium-based alloy casting as recited in claim 6 in which the master additive alloy consists of 90% aluminum by weight and 10% titanium by weight.

* * * * *